US006318574B1

(12) United States Patent
Holt

(10) Patent No.: US 6,318,574 B1
(45) Date of Patent: Nov. 20, 2001

(54) PRODUCT DISPLAY

(76) Inventor: Andy Holt, 2507 E. 21st St., Des Moines, IA (US) 50317

( * ) Notice: Subject to any disclaimer, the term of this patent is extended or adjusted under 35 U.S.C. 154(b) by 0 days.

(21) Appl. No.: 09/591,843

(22) Filed: Jun. 12, 2000

Related U.S. Application Data

(63) Continuation-in-part of application No. 09/339,666, filed on Jun. 24, 1999, now Pat. No. 6,071,037, which is a continuation-in-part of application No. 08/984,113, filed on Dec. 3, 1997, now Pat. No. 6,173,530.

(51) Int. Cl.[7] ..... B65D 25/00
(52) U.S. Cl. ..... 220/4.03; 206/756
(58) Field of Search ..... 220/4.03, 4.11; 404/6; 206/756

(56) References Cited

U.S. PATENT DOCUMENTS 3,990,179 * 11/1976 Johnson et al. ..... 220/4.03
4,852,757 * 8/1989 Gold ..... 220/4.03
5,448,844 * 9/1995 Miller et al. ..... 40/611
5,605,242 * 2/1997 Hwang ..... 220/4.03
5,674,103 * 10/1997 Bean ..... 220/4.03
5,803,293 * 9/1998 Lovekin ..... 220/4.03
5,913,439 * 6/1999 Von Arx ..... 220/4.03
6,071,037 * 6/2000 Holt ..... 454/6
6,173,530 * 1/2001 Holt ..... 220/4.11

* cited by examiner

*Primary Examiner*—Joseph M. Moy
(74) *Attorney, Agent, or Firm*—Frank A. Lukasik

(57) ABSTRACT

A traffic control barrier consisting of an inverted, first barrel liner base, a circular connecting ring fitted over the bottom of the base, a second, upright, barrel liner fitted within the circular connecting ring, and an inverted, third barrel liner placed atop the second barrel liner and snapped together with a pair of rubber clips. A second embodiment eliminates the third barrel liner and a floor shelf is supported within the second barrel liner to form a product display.

3 Claims, 11 Drawing Sheets

PRODUCT DISPLAY

RELATED APPLICATIONS

This is a Continuation-In-Part of U.S. patent application Ser. No. 08/984,113, Filed Dec. 3, 1997 now U.S. Pat. No. 6,173,530, and 09/339,666, Filed Jun. 24, 1999. now U.S. Pat. No. 6,071,037.

BACKGROUND OF THE INVENTION

1. Field of the Invention

The present invention relates generally to traffic control and more particularly to a barrel liner used in constructing traffic barriers and for displaying products.

2. Description of the Prior Art

Traffic barriers are widely used to delineate roadways, detours, hazardous zones and other special traffic circumstances. The barriers are sometimes composed of folding "sandwich" board forms or simple cones. Although such ubiquitous barriers are effective in certain conditions, they can, by their very design, present a hazard to traffic. Cones can easily become displaced from their intended position by vehicles striking them because they are too low below the driver's line-of-sight and drivers are unable to judge accurately where they are. As a result of such displacement, they can come to rest directly in the path of following vehicles thereby presenting a potential hazard as other drivers swerve to avoid them.

Another means for providing traffic signal devices is the use of large barrel shaped drums. Although the drums provide larger visual displays, they are large and bulky and take up much space while being transported to a site or while being stored for use.

Folding barriers present a similar hazard in that they are also difficult for some drivers to see under certain conditions. A vehicle striking such a barricade can be severely damaged and the barrier, by virtue of its metal construction, can be propelled intact into an approaching vehicle. A highly visible and stable barricade composed of flexible sturdy plastic such as the instant invention, in its preferred embodiment, provides a safe alternative to existing roadside barriers.

In addition to the above, another use for barrel type containers, or stacking containers, is to provide varying displays and are well known and have been in use for many years. The same lack of flexibility and difficulty in transport or storage also applies to displays.

It is therefore one object of the invention to provide an affordable barrel which is readily assembled for use as traffic barriers.

A further object is to provide improved means for displaying merchandise for sale.

Another object of the invention is to provide an affordable barrel which may be conveniently stacked to be used as traffic signals or as a display device for merchandise.

SUMMARY OF THE INVENTION

The traffic control barrier of the invention consists of a lower, a middle, and an upper container that may be selectively joined to form a stacked assembly. The barrier comprises a plastic, barrel liner shaped container, similar to the type used to retain water for growing aquatic plants as described in the parent application mentioned above. The barrel liner comprises a top rim having a lip formed around the periphery. The barrel liner is elongated to form a deep chamber. The barrier is comprised of three barrel liners with a first liner inverted and used as a base, a second liner is placed atop the first container, right side up, and the two liners are held together with a plastic joining section. A third liner is then inverted and placed atop the second liner and the matching rims are clipped together with a pair of rubber clips.

In a second embodiment, only the two lower barrel liners are used and the combination of the inverted base liner, with the second liner joined with the plastic joining strip, may be used as a merchandise display unit in a sales room or market.

DETAILED DESCRIPTION OF THE INVENTION

Referring to FIGS. 1 through 4, a traffic control barrier is designated generally by the numeral 10. FIGS. 1–9 depict the modular components of the barrier 10. In a preferred embodiment, the barrel liners were made from high impact plastic.

Figure 1:
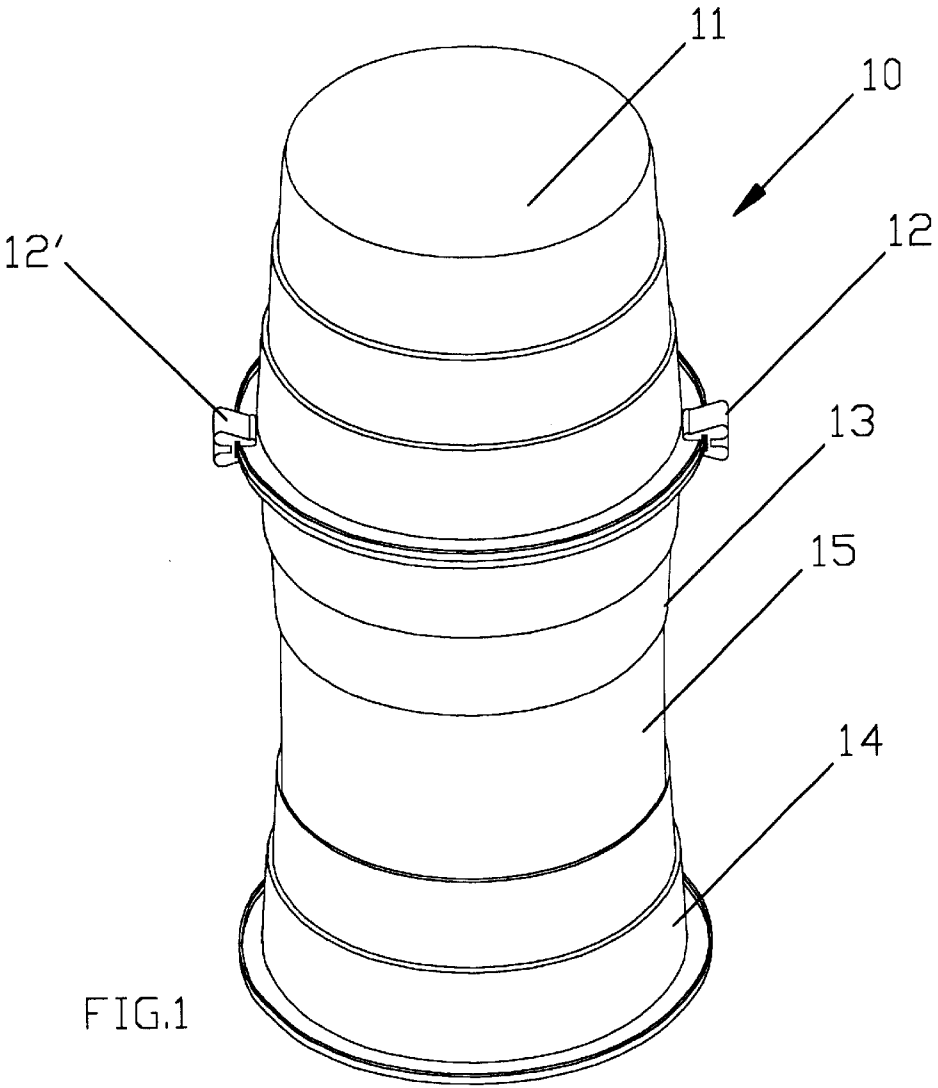
FIG. 1 is a top, perspective front view, of a first embodiment of the invention assembled as a traffic control barrier.
Figure 4:
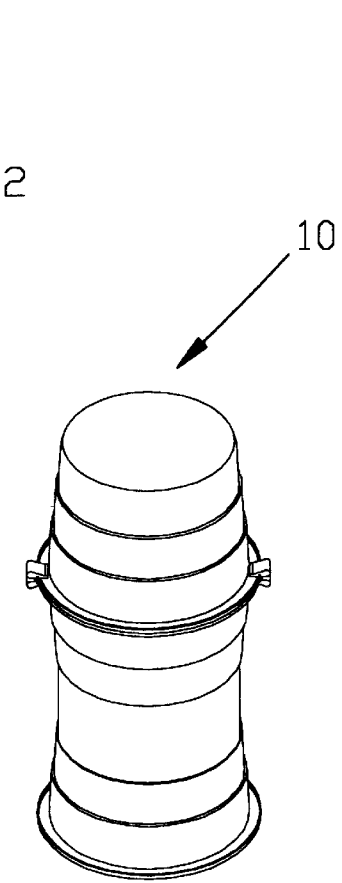
FIG. 4 is a top perspective view of a first embodiment of the invention assembled as a traffic barrier as shown in FIG. 1.
Figure 3:
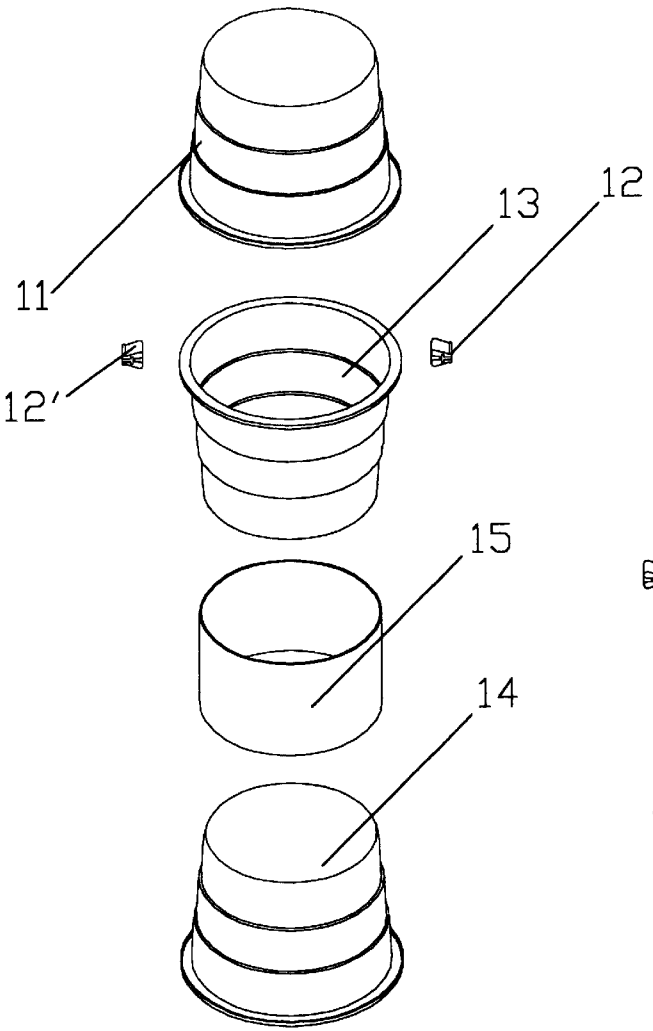
FIG. 3 is an exploded perspective view of the entire traffic barrier in accordance with the invention.
Figure 2:
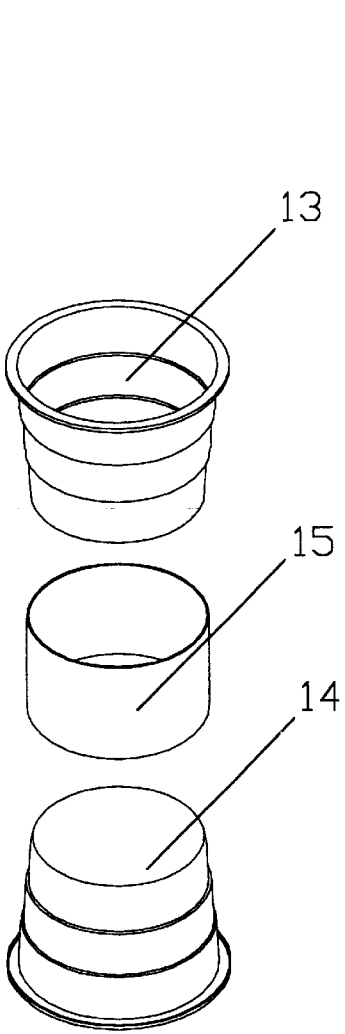
FIG. 2 is a an exploded perspective view of a traffic control barrier in accordance with the invention.
Figure 6:
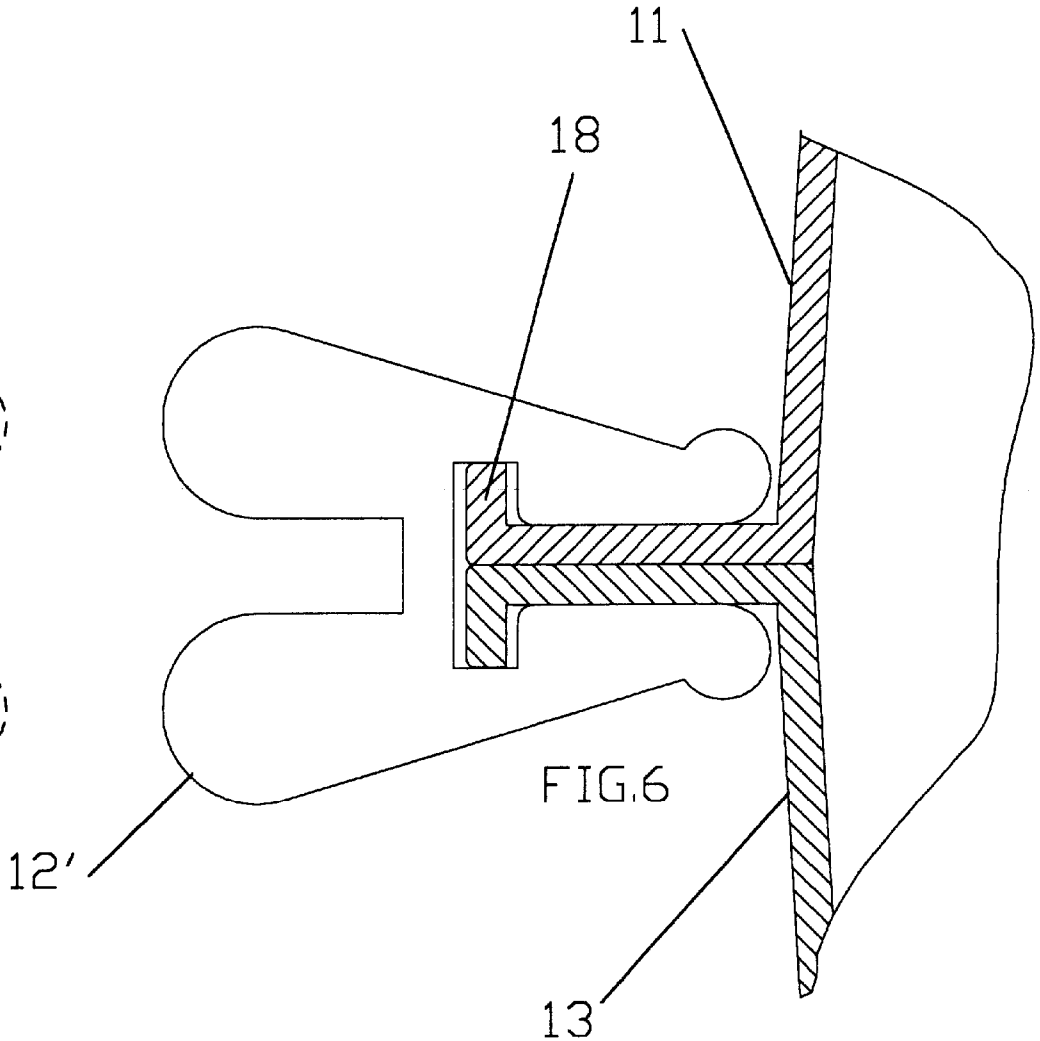
FIG. 6 shows a rubber clip in position as connector for two barrel liners.
Figure 5:
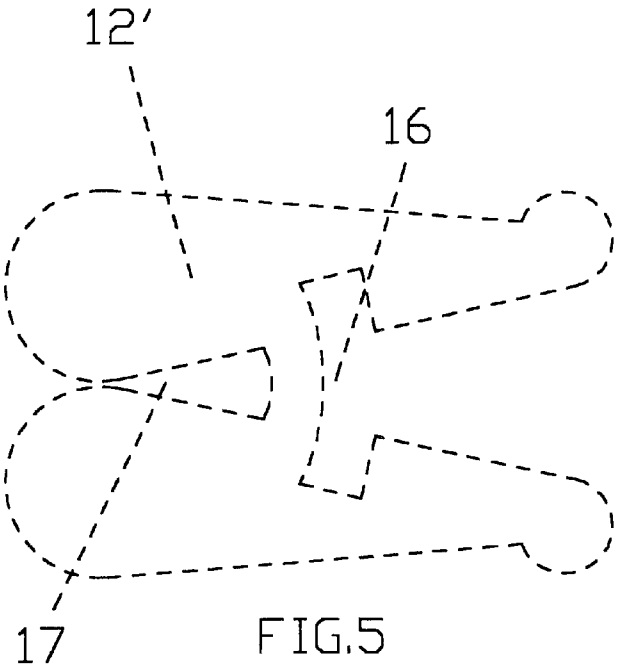
FIG. 5 is a side view of a rubber clip shown in broken lines illustrating an open position.

FIGS. 2–4 show the modular nature of the instant invention in an assembly sequence. FIG. 2 depicts the barrel liner base unit 14 in an inverted state, resting upon the ground and retaining collar 15 provides a secure location for the fitting of a second barrel liner 13 in an upright position. A third barrel liner 11 (FIG. 3) is inverted and placed atop second barrel liner 13 with the rims 18 of each of the liners 11 and 13 fastened together with rubber clips 12 and 12' which are snapped into position to retain inverted liner 11 mated with liner 13.

FIG. 4 is a top perspective view of the traffic barrier 10 fully assembled as above.

Figure 8:
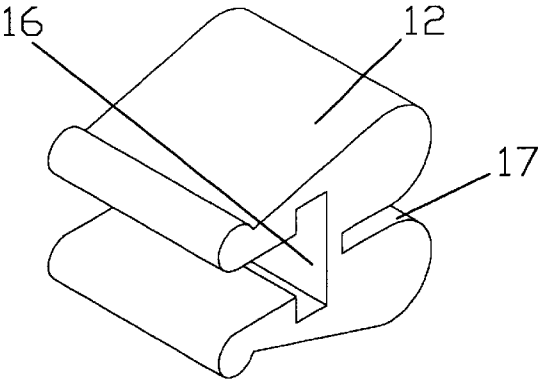
FIG. 8 is a top perspective view of a rubber clip connector.
Figure 7:
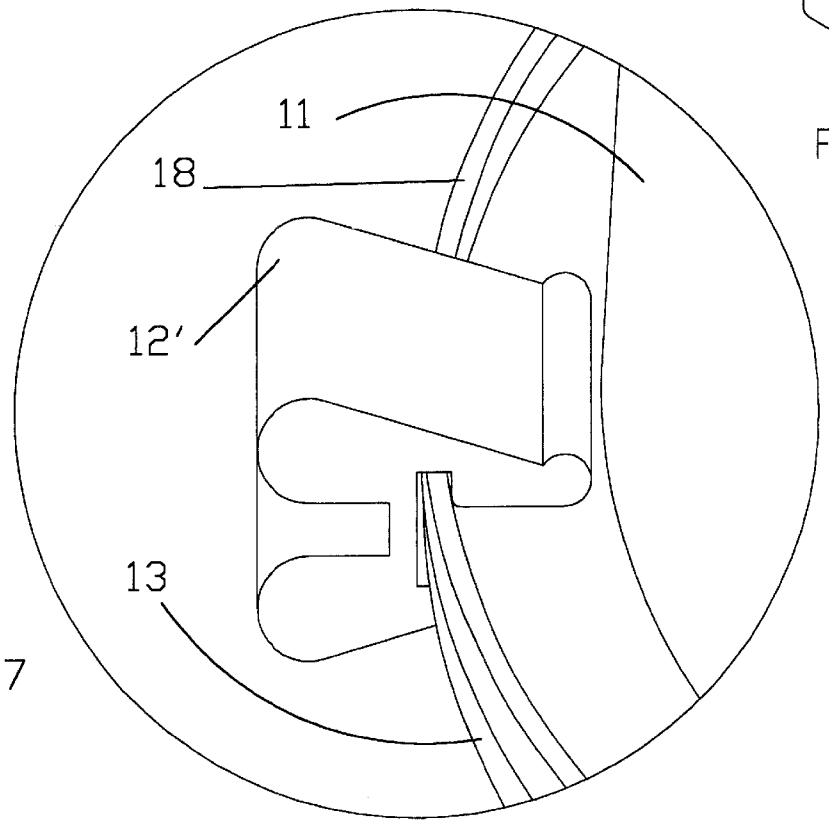
FIG. 7 is a perspective view showing a rubber clip in position to connect two barrel liners.
Figure 9:
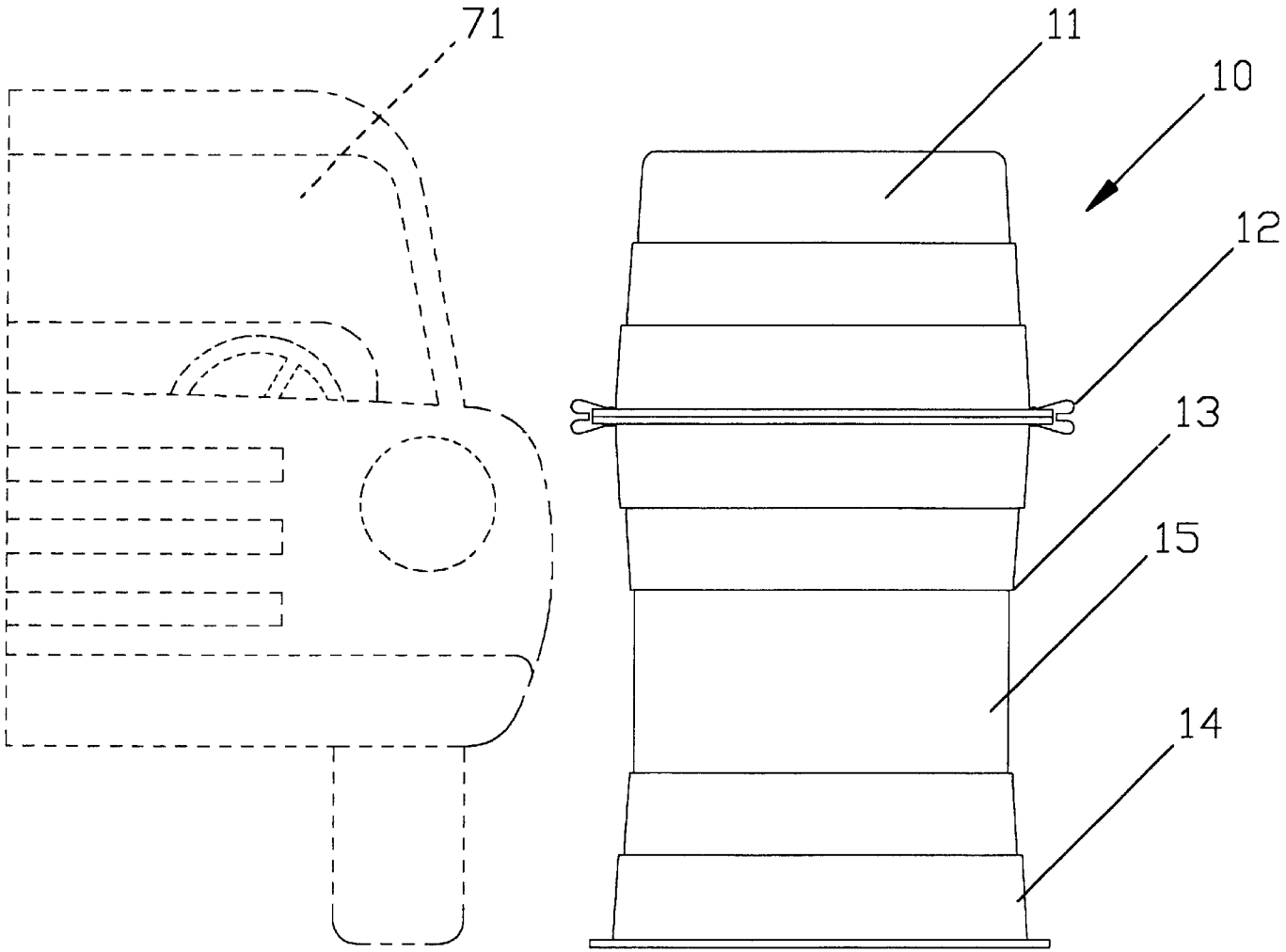
FIG. 9 shows a side view of a traffic barrier in accordance with the invention.

Referring to FIGS. 5–8, rubber clip 12', is shown by broken lines in its open position ready to be snapped in place over rims 18. Gaps 16 and 17 provide opening and closing spaces respectively to allow the clip 12' to engage rims 18 and then return to its former shape, thus locking itself and modular components, liners 11 and 13 together. FIG. 7 is an expanded perspective view showing how a rubber clip 12' seats in position with rim 18 clenched securely within gap 16. FIG. 8 is a is a perspective view of rubber clip 12 showing the gaps 16 and 17. FIG. 9 shows the assembled traffic barrier 10 in relation to a vehicle 71.

Figure 10:
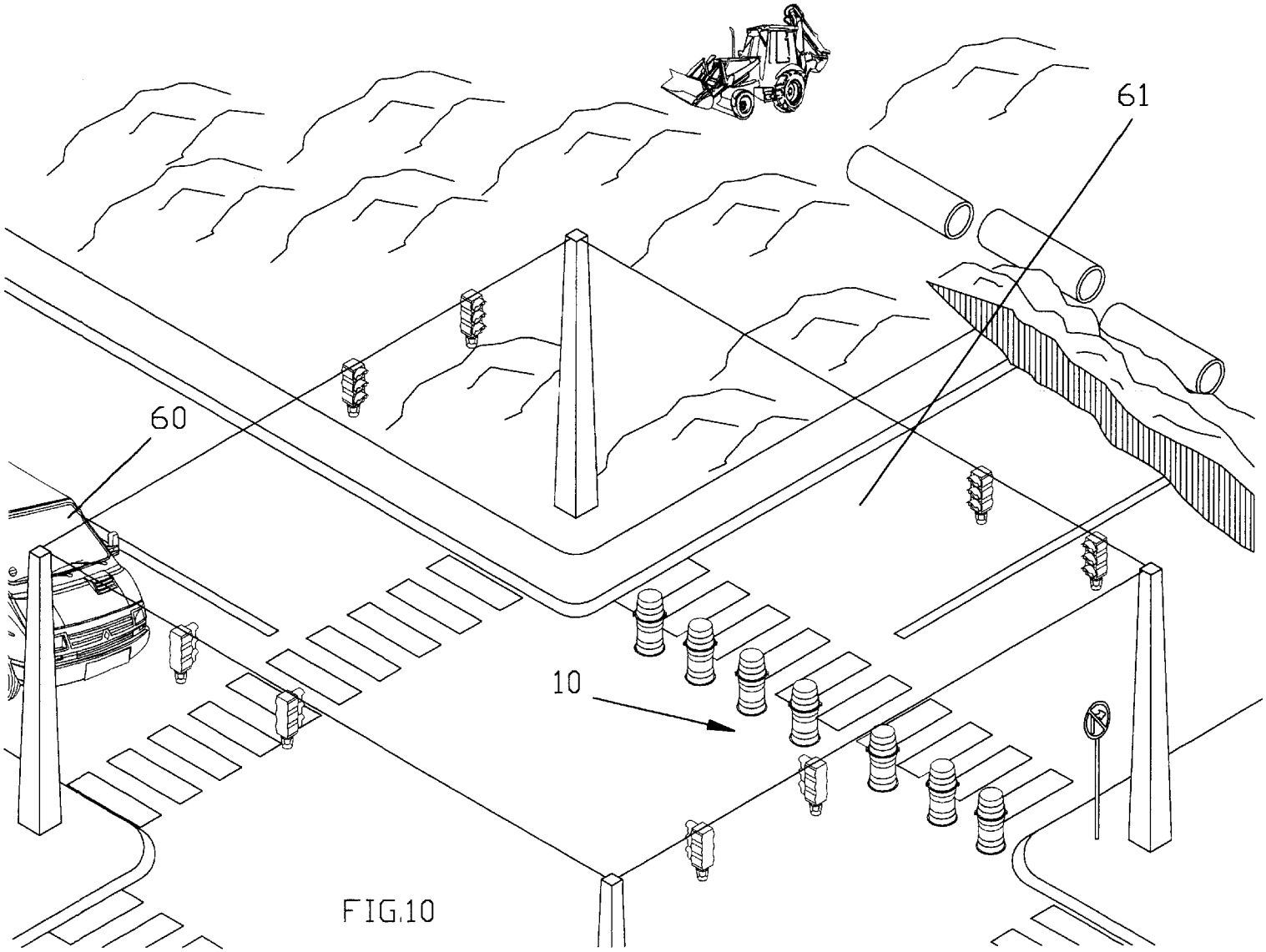
FIG. 10 is a top perspective of an application of the traffic barrier in accordance with the invention.

Referring now to FIG. 10, there is shown an application of the traffic barrier 10. A row of traffic control barriers 10 provide a visible barrier to vehicle 60 such that there appears to be a substantial and impenetrable line of demarcation preventing access to construction roadway 61.

Figure 11:
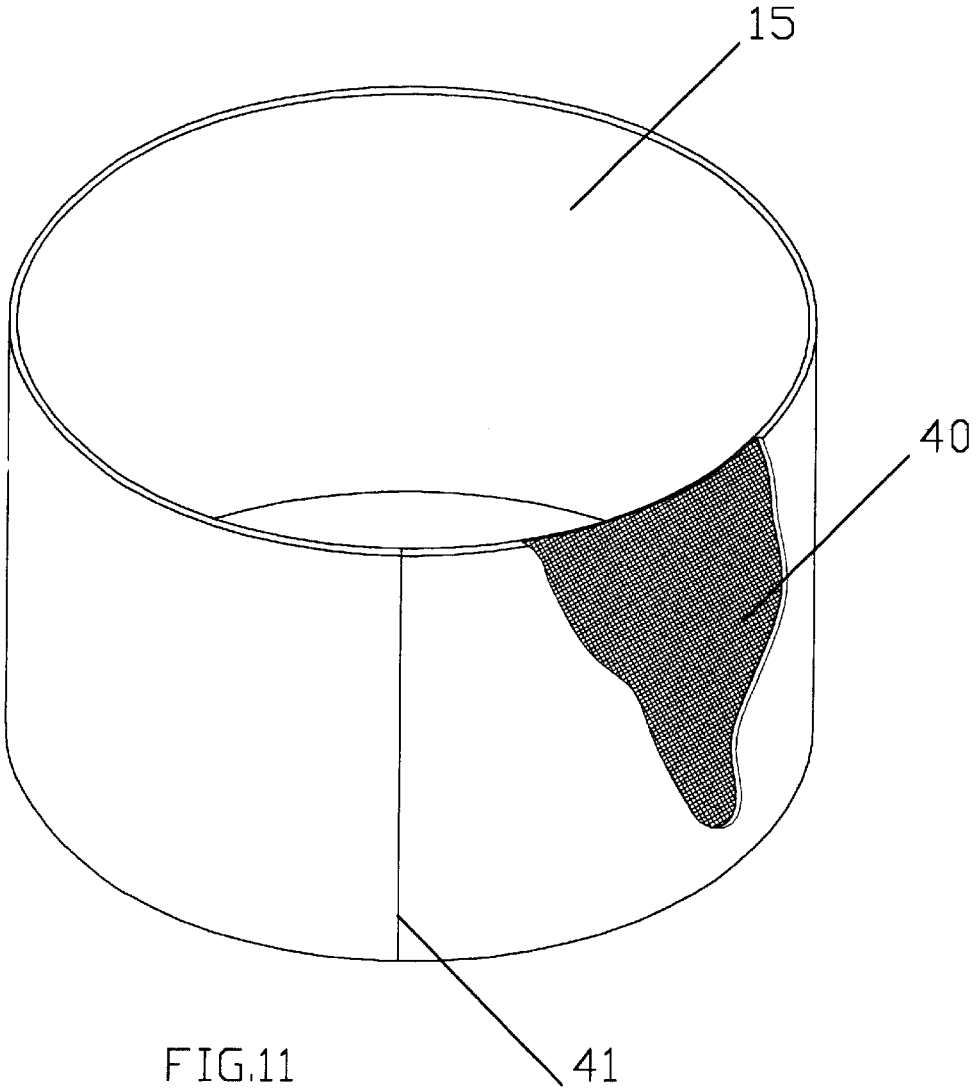
FIG. 11 is a top perspective view, partly in section, of a retaining collar in accordance with the invention.

FIG. 11 is a top perspective view of a connecting ring 15 used in the preferred embodiment of traffic control barrier 10. Connecting ring 15 may be a simple ring of plastic impregnated cloth weave which is strong enough to use to connect together the lower sections, barrel liners 13 and 14 while still providing a non-hazardous component of a traffic control barrier system 10.

Figure 12:
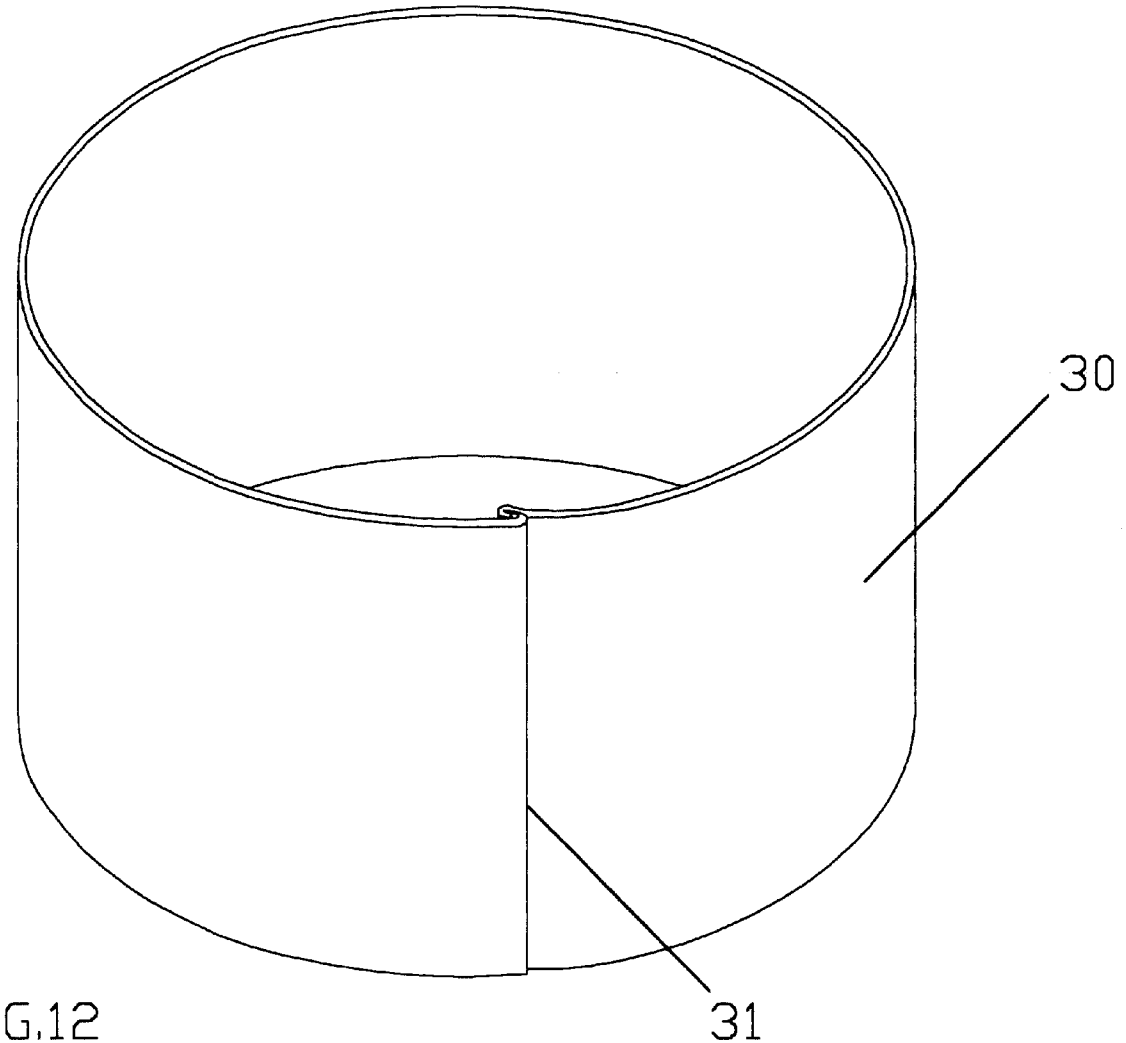
FIG. 12 is a top perspective view of a steel retaining collar in accordance with the invention.

FIG. 12 is a top perspective view of a steel connecting ring 30 which is made of rolled steel with its ends rolled over to form a mating joint 31. The ring 30 may be painted suitably for use in the second embodiment of the instant invention, namely a display means for stores, markets, and trade shows, for example.

Figure 13:
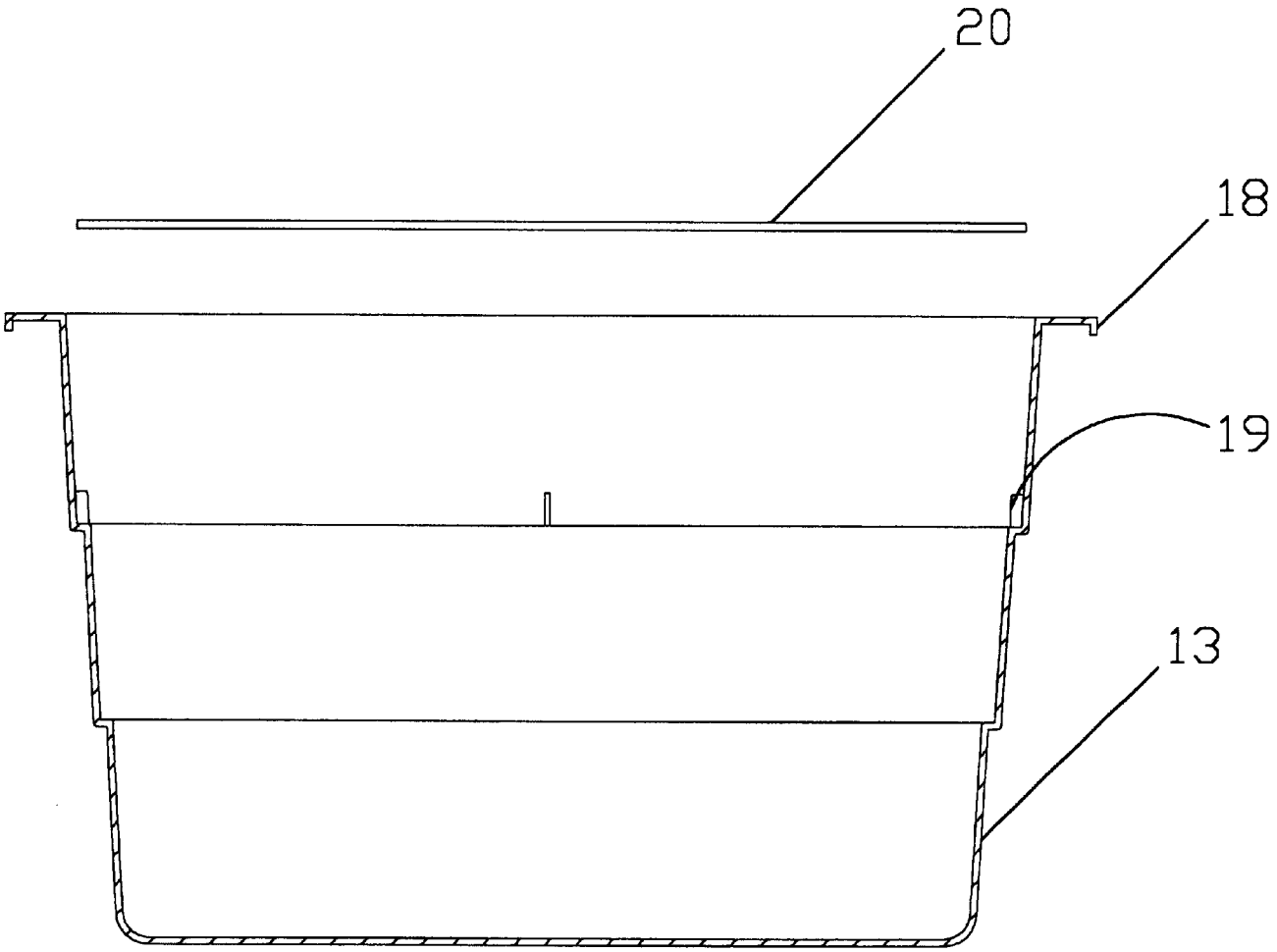
FIG. 13 is a side view, in section, of a barrel liner.
Figure 14:
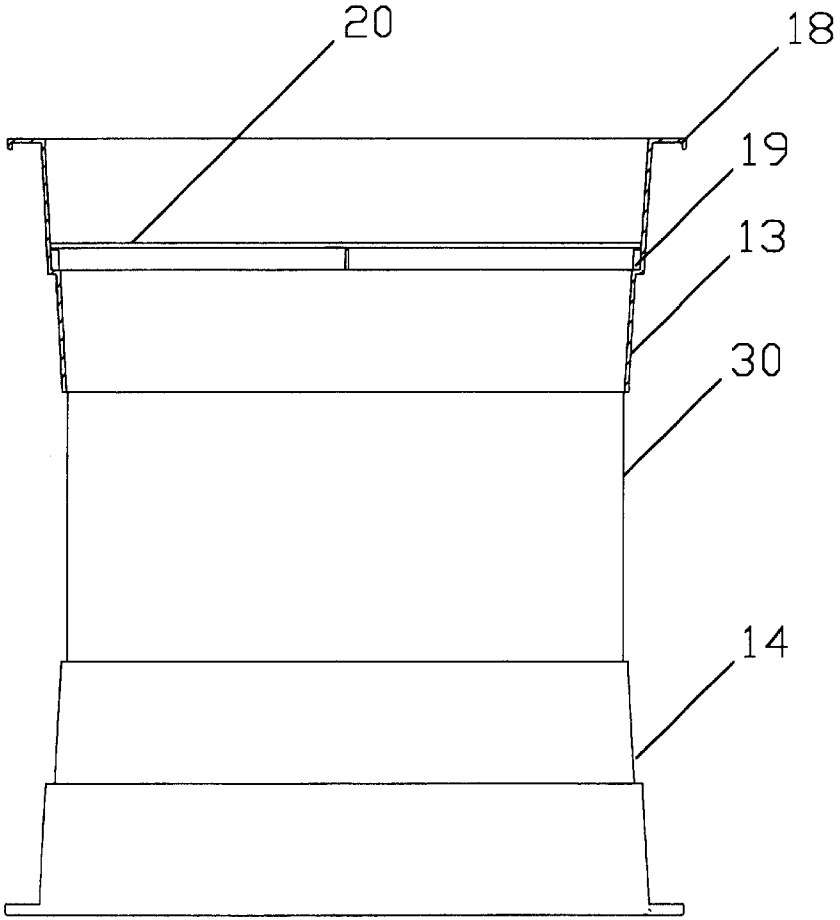
FIG. 14 is a side view, partly in section, showing the component parts of a second embodiment of the invention.
Figure 15:
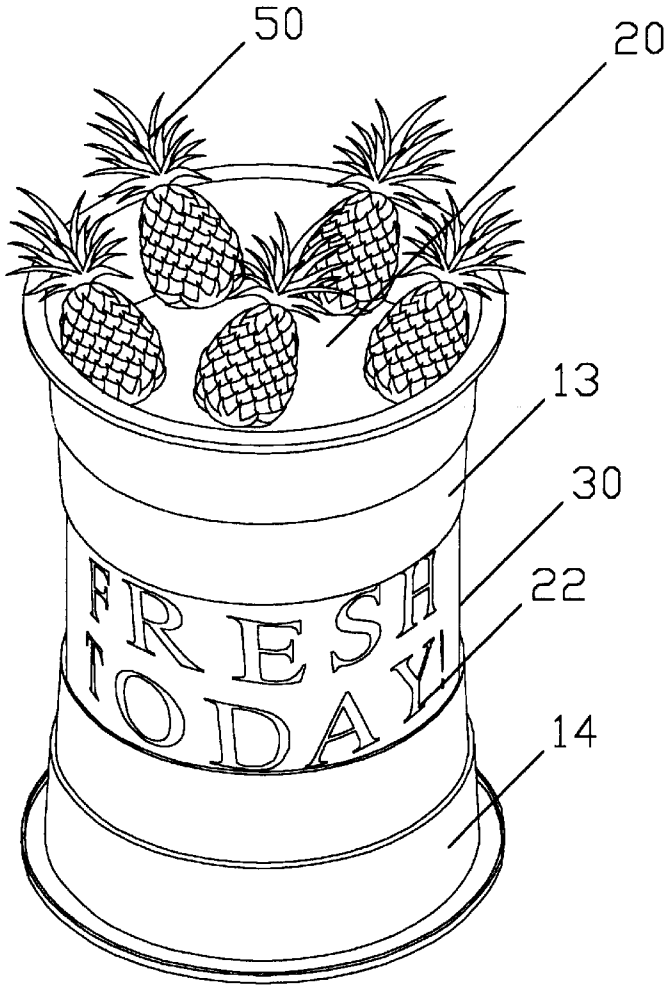
FIG. 15 is a top perspective view of a display barrel liner assembly in accordance with the invention.

FIGS. 13–15 show the component parts of a second embodiment of the invention using two barrel liners 13 and 14 joined by connecting ring 30 to form the display means. The modification which makes the second embodiment distinct from the first is the use of elevated floor shelf 20 as shown in FIG. 13 and the omission of inverted barrel liner 11 used as the cover in the first embodiment. FIG. 14 shows, partly in section, a side view of the second embodiment with floor shelf 20 in place resting on ledge 19 within barrel liner 13. Connecting ring 30 (steel) retains both barrel liner 14 and and barrel liner 13.

FIG. 14 shows in perspective view, the second embodiment of the instant invention as a store display for pineapples 50 as an example of possible use. Connecting ring 30 has been imprinted with signage 22.

While a principle of the present invention has been described above in connection to a preferred embodiment of the invention, it is intended that all matter contained in the above description and illustrated in the accompanying drawings shall be interpreted to be illustrative and not in a limiting sense.

What is claimed is:

1. A product display for stores, markets, and trade shows, said product display consisting of:

a first plastic, barrel liner base unit having a top rim, a bottom, and a lip formed around the periphery of said top rim, said barrel liner base unit being placed in an inverted position on a selected surface, a circular connecting ring fitted over said bottom of said first barrel liner base unit, a second barrel liner having a top rim, a bottom, an internal ledge formed within said second barrel liner, and a lip formed around the periphery of said top rim, said bottom of said second barrel liner being fitted within said circular connecting ring, and a floor shelf inserted within said second barrel liner and being held in place by said internal ledge.

2. A product display as defined by claim 1 wherein said barrel liners are made from high impact plastic and said connecting collar is a simple ring of plastic impregnated cloth weave.

3. A product display as defined by claim 1 wherein-said barrel liners are made from high impact plastic and said connecting collar is a ring of rolled steel with its ends rolled over to form a mating joint.

* * * * *